US006802773B2

(12) United States Patent
Moody

(10) Patent No.: US 6,802,773 B2
(45) Date of Patent: Oct. 12, 2004

(54) BAD BEAT VIDEO POKER GAME FEATURE

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 375 days.

(21) Appl. No.: 10/140,636

(22) Filed: May 7, 2002

(65) Prior Publication Data

US 2002/0169015 A1 Nov. 14, 2002

Related U.S. Application Data

(60) Provisional application No. 60/290,478, filed on May 10, 2001.

(51) Int. Cl.[7] ..... A63F 9/22

(52) U.S. Cl. ..... 463/13; 273/292

(58) Field of Search ..... 463/10–13, 16–20, 463/25; 273/292, 138.1, 138.2, 143 R, 269; 283/903

(56) References Cited

U.S. PATENT DOCUMENTS 5,401,023 A * 3/1995 Wood ..... 463/13
5,511,781 A * 4/1996 Wood et al. ..... 463/13
5,695,402 A * 12/1997 Stupak ..... 463/20
5,845,907 A * 12/1998 Wells ..... 273/292
6,007,424 A * 12/1999 Evers et al. ..... 463/13
6,070,876 A * 6/2000 Ko ..... 273/293
6,102,400 A 8/2000 Scott ..... 273/269
6,102,402 A * 8/2000 Scott et al. ..... 273/292
6,345,823 B1 * 2/2002 Webb ..... 273/292
6,569,014 B2 * 5/2003 Walker et al. ..... 463/13

* cited by examiner

*Primary Examiner*—Mark Sager
*Assistant Examiner*—Steven Ashburn
(74) *Attorney, Agent, or Firm*—John Edward Roethel

(57) ABSTRACT

A method for conducting a multiple hand video poker game incorporating a bad beat feature begins with a player making a wager to receive a first hand of cards. The player holds zero or more cards and the held cards are reproduced into additional poker hands. Replacement cards are dealt into each hand to form completed poker hands. The player is rewarded for each winning hand combination. Additionally, if the player's first hand prior to replacement matches one of a set of qualifying starting hands and none of the player's completed poker hands matches a final hand corresponding to the qualifying starting hand obtained, a bad beat award is issued to the player.

17 Claims, 4 Drawing Sheets

BAD BEAT VIDEO POKER GAME FEATURE

RELATED APPLICATION DATA

The present application claims the priority of U.S. Provisional Application Serial No. 60/290,478, entitled "Bad Beat Video Poker Game Feature" filed May 10, 2001.

FIELD OF THE INVENTION

This application relates to a method of playing video poker games with multiple hands, and more particularly to a bad beat feature that is incorporated into video poker games with multiple hands so that the player may be awarded with a payout when the player starts with a plurality of good initial hands and fails to improve any of the hands.

BACKGROUND OF THE INVENTION

U.S. Pat. No. 5,823,873 (Moody), the disclosure of which is incorporated herein, discloses multiple hand video poker games. In a three hand version of this game as disclosed in this patent, a player wagers on three hands. A first hand is dealt and the player selects which of the initially dealt cards, if any, the player wishes to hold. Each held card is duplicated or re-used in the other two hands. Replacement cards for the discarded cards are dealt into each of the three hands and the final poker hand rankings of each hand are determined. Using a pay table, the player is awarded for winning hand combinations based on the amount wagered by the player and the poker hand ranking of each final hand.

This patented method of play has been commercialized in many versions: TRIPLE PLAY™ Poker, FIVE PLAY™ Poker, TEN PLAY™ Poker, FIFTY PLAY™ Poker and HUNDRED PLAY™ Poker have all been commercially successful games and can be played in many casinos throughout the United States and in other countries. During the play of these multiple hand games, a player may be dealt a good starting hand, say four cards to a flush. The player holds all four cards of the same suit and hopes that many of the hands will improve to a five card flush which would be a winning hand combination. The vagaries of mathematical probability being what they are, it is possible that none of the hands will improve to a five card flush and each final hand will end up being a non-winning card combination. This can be very disappointing to a player. If a player were playing TEN PLAY™ Poker, FIFTY PLAY™ Poker or even HUNDRED PLAY™ Poker and was dealt a four card flush hand and failed to improve any of the hands to a five card flush, the player could reasonably be expected to feel he had suffered a "bad beat."

Operators of live poker room gaming have used different types of inducements to encourage player participation. Besides free coffee and donuts, many operators also provide what is known as a "bad beat" jackpot. The operator makes a "bad bet jackpot" payment to a player who has an unusually high ranking poker hand, but loses the pot to another player with an even higher ranking poker hand.

The concept of a bad beat jackpot award appears to have had its genesis in casino poker rooms. Typically the operator of the poker room seeds a bad beat award at some beginning level amount, say $1,000.00. The bad beat award can remain as a fixed amount until won by a player or the bad beat award can be a progressive amount which increases each hour or day until won. The progressive bad beat award can also increase based on the amount of play occurring at the poker table. For example, a portion of the "rake" generated during the live poker play can be used by the card room operator to increase the progressive amount of the bad beat award.

In order to win the bad beat award in the typical casino poker room, a player must have a high ranking poker hand, but lose the regular game pot to another player. For example, a player can be holding four-of a-kind (sixes) and lose the hand to another player holding four-of a-kind (tens). Even though the player holding Four Sixes may have lost the regular pot, the player wins the bad beat award which could be several thousand dollars. Often this bad beat award is divided among all of the players at the table, with the player holding the bad beat hand winning the major portion of the jackpot.

U.S. Pat. No. 6,102,400 (Scott et al.) discloses generally the concept of adding a bad beat award to other casino games such as keno, bingo, craps, electronic video poker and slot machines. With regard to electronic video poker, this patent discloses comparing the player's final hand to a five card hand held by a dealer. If the player's hand is at least a flush and the dealer has a better poker hand, then the player is awarded a bad beat payout.

It is an object of the present invention to provide a bad beat feature of multiple hand video poker games so that a player who has been dealt a good starting hand that fails to improve can still receive an award.

It is a feature of the present invention to provide a bad beat payout to a player who is playing a multiple hand game when the player fails to improve a good starting hand. For example, if the player is playing FIVE PLAY™ Poker and is dealt a four card flush and the player holds all four cards of the same suit and achieves no flushes after the draw step, then the player is awarded a separate payout for this bad beat. A portion of each wager made by the player can be accumulated in a bad beat payout display which can increment until won by a player. Alternatively, a flat amount can be awarded each time the player suffers a bad beat.

It is an advantage of the present invention that the player will receive a payout when the player fails to improve a good starting hand in a multiple hand video poker game. The method of present invention rewards both an unlucky player who fails to improve his good starting hand and also awards a lucky player who improves one or more of his good starting hands. Another advantage of the present invention is that the hit frequency of the multiple hand video poker game is increased to make the game more appealing to the player.

Other objects, features and advantages of the present invention will become apparent from a consideration of the following detailed description.

SUMMARY OF THE INVENTION

The present invention comprises a method of incorporating a bad beat feature into a multiple hand video poker game. A player makes a wager to play a plurality of video poker hands. A first hand is dealt and the player selects which cards to hold, if any. Any held cards are duplicated or reused in the other poker hands and additional cards are dealt to each hand to complete the poker hands. The player is awarded a payout for each winning hand combination achieved based on the amount wagered by the player.

If the player holds cards comprising one of a preselected group of qualifying starting hands and none of these hands improve to a corresponding final hand, then the player receives a bad beat award, which may be either a flat amount or a progressive amount. This compensates the player for being unlucky in not improving any of his hands.

DETAILED DESCRIPTION OF THE PREFERRED EMBODIMENTS

Figure 4:
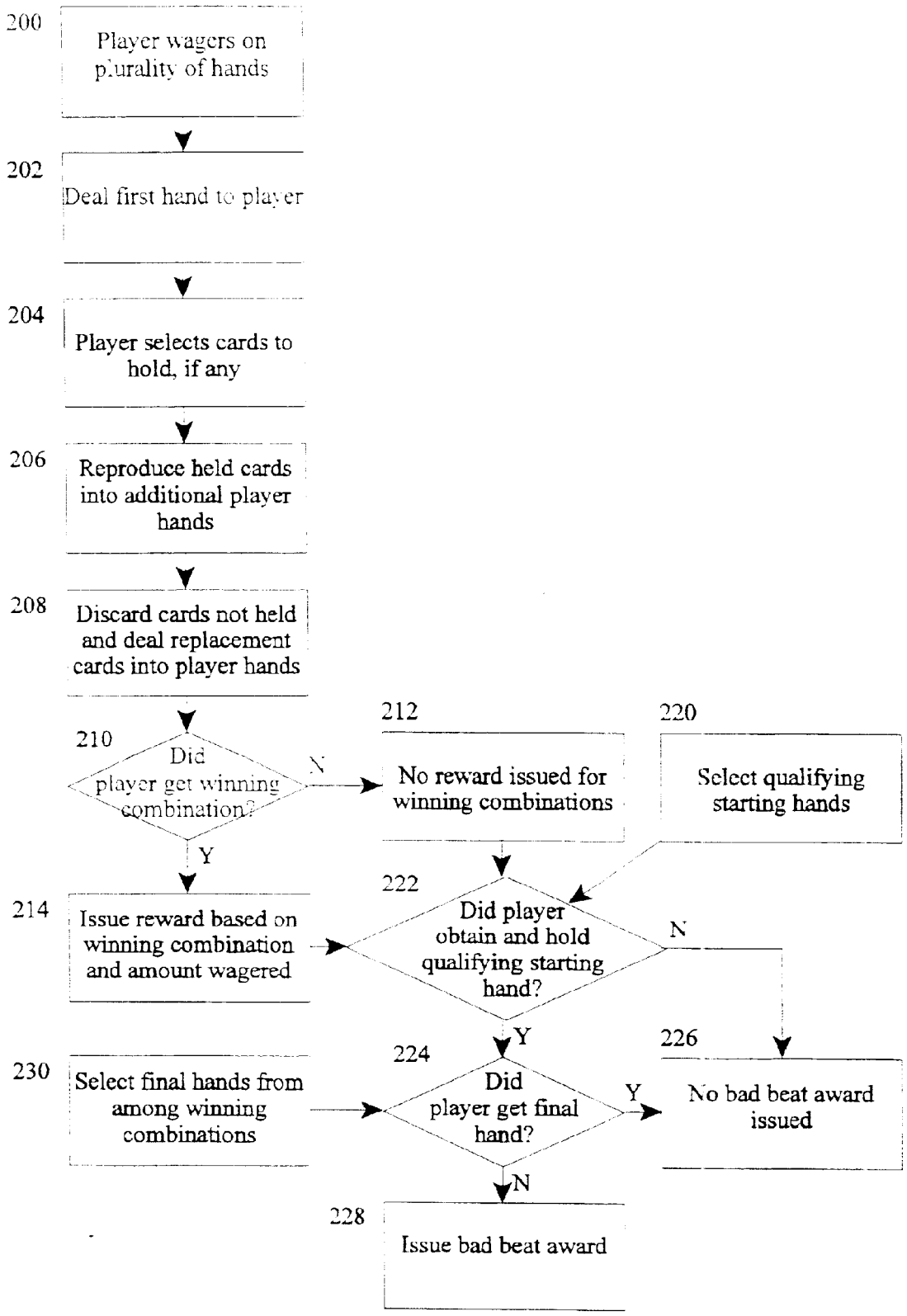
FIG. 4 shows a flowchart of a method according to an embodiment of the present invention.

Reference is now made to the figures wherein like parts are referred to by like numerals throughout. The method of the present invention is directed to conducting a multiple hand video poker game incorporating a bad beat feature. Referring first to FIG. 4, the multiple hand video poker game is initiated by a player making a wager 200 to play a plurality of video poker hands. A first hand of cards is dealt 202 to the player and the player selects 204 which cards, if any, of the first hand to hold. The held cards are reproduced 206 into the additional poker hands. The cards of the first hand not held are discarded and replacement cards are dealt 208 into each hand to form completed poker hands. The player's hands are compared 210 to a set of winning combinations. The player is rewarded 214 for each hand combination matching a set of predetermined winning hand combinations based on the amount wagered by the player. Any hands not holding a winning combination lose and no reward is issued 212.

The bad beat feature of the present method includes selecting one or more final hands 230 from the winning hand combinations and one or more qualifying starting hands 220, each of the qualifying starting hands corresponding to at least one selected final hand. The qualifying starting hands are the hands that a player must obtain and hold to be eligible for the bad beat award. The final hands are the hands that will disqualify a player from receiving the bad beat award. In other words, if the player's first hand prior to replacement matches 222 one of the qualifying starting hands and none of the player's completed poker hands matches 224 the final hand corresponding to the qualifying starting hand obtained, a bad beat award is issued 228 to the player. Conversely, if the player's first hand prior to replacement does not match 222 one of the qualifying starting hands or if any of the player's completed poker hands match 224 the final hand corresponding to the qualifying starting hand obtained, that is, the player's qualifying starting holding improves to the corresponding final holding after replacement in any of the player's hands, no bad beat award is issued 226.

For example, in one embodiment of the present invention, a qualifying starting hand is four-to-a-flush and the corresponding final hand is a flush. Thus, if a player initially obtains and holds four-to-a-flush (i.e. four suited cards and an unsuited card) the player will only be eligible for a bad beat award if none of the player's active hands form a flush. Similarly, an an alternate or additional embodiment, a qualifying starting hand is four-to-a-straight (i.e. four cards with which a fifth card would form a straight and another card) and the corresponding final hand is a straight. In this manner, any number and type of qualifying starting hands and corresponding final hands may be selected.

In selecting the qualifying starting hands and the final hands, it is contemplated that a qualifying starting hand comprise a hand containing one or more but fewer than all the cards necessary to form a corresponding final hand.

The method of play of the present invention is practiced using a conventional electronic video poker machine which has been programmed and configured to present the method of play to a player. In the optional embodiment of the figures, a player plays five hands of video poker using a multiple hand format. If the player's starting hand is a four card flush or a four card straight and the player fails to improve his starting hand to a selected final hand after the draw round of the game, the player wins a bad beat award.

Figure 1:
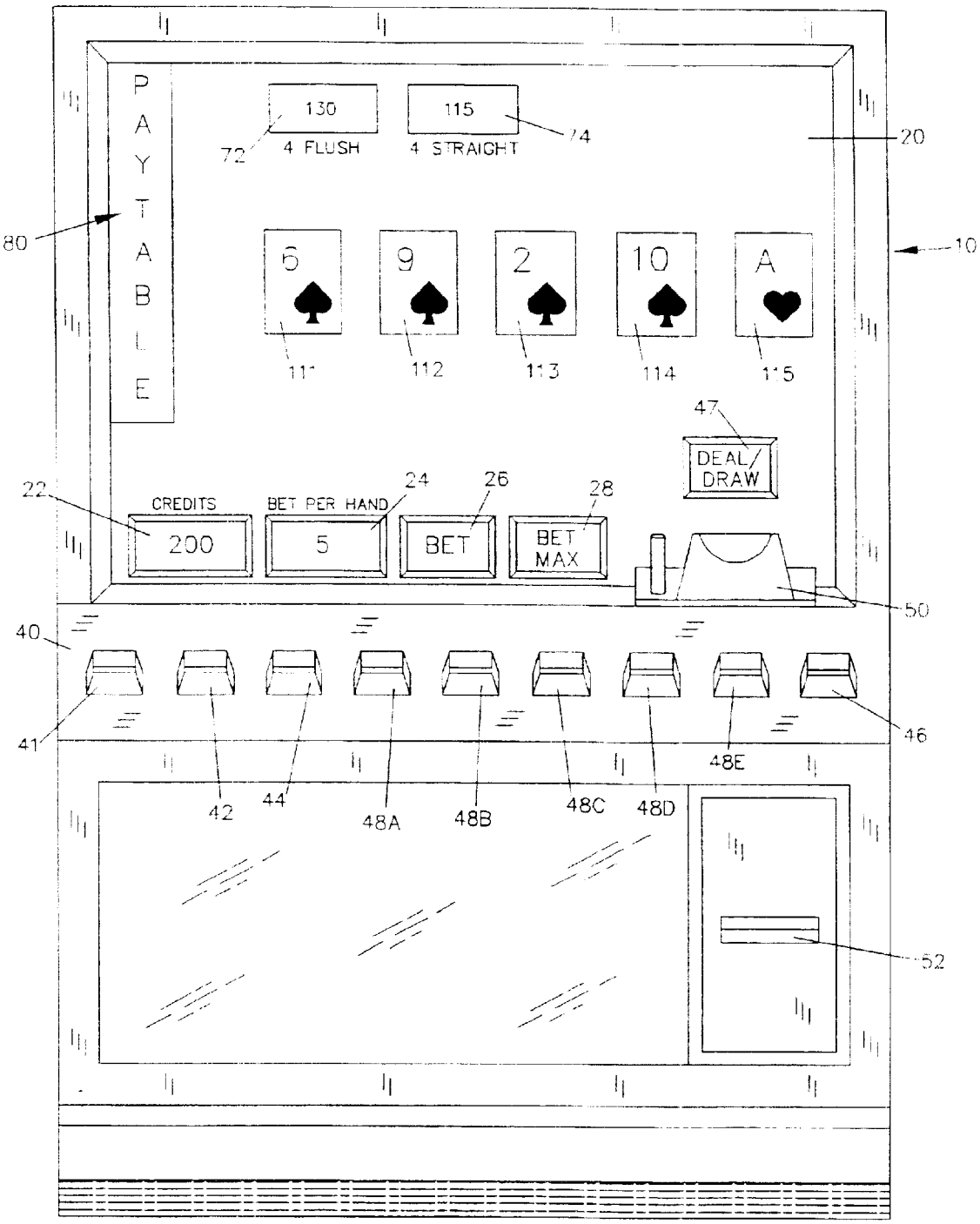
FIG. 1 shows a gaming machine configured to operate the method of the present invention including a representative initial deal for the method of the present invention.

FIG. 1 shows a representative gaming machine upon which the method of the present invention can be carried out. The gaming machine 10 includes a video screen display 20 which shows the playing cards that will be used during the play of the method of the present invention. The video screen display 20 also includes other information and data presented to the player to allow the player to understand the play of the game and to effect the operation of the method. In the preferred embodiment of the present invention, the video screen display 20 shows a "4 FLUSH" meter 72 and a "4 STRAIGHT" meter 74 upon which are displayed the bad beat awards that can be won by the player as described below.

In the preferred embodiment of the present invention, the video screen display 20 also shows a credit meter 22 and a display of the "bet per hand" 24 which is the number of credits wagered on each hand for a particular round of play of the game. The video screen display also has a DEAL/DRAW touch screen location 47 to allow the player to cause the initial deal of the cards to be displayed on the video screen display 20. Other touch screen locations allow the player to make his initial wager, which can be made one credit at a time using the BET ONE location 26 or which can be made by wagering the maximum number of credits allowed by the gaming machine using the BET MAX location 28.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allows the player to wager either the maximum amount of credits or to wager one credit at a time on the play of the game as desired by the player, if the player wishes to use buttons to place his wager instead of using the touch screen locations BET ONE 26 and BET MAX 28 to place his wager. A DEAL/DRAW button 46 is provided to allow the player to effect the initial deal step of the method of play as desired should the player prefer to use the button panel 40 instead of the DEAL/DRAW screen location 47 on the video screen display 20.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine, is mounted a bill acceptor which takes in and validates the currency. The monetary value of the inserted currency is then applied to the credit meter 22, the credits on which the player may use to play the gaming machine.

A plurality of buttons 48 can also be provided on the button panel 40 to allow the player to select which cards the player wishes to hold. Each button preferably is aligned beneath the associated card position shown in the screen display 20. Instead of using the buttons 48 on the button panel 40, the video screen display 20 can be provided with touch screen locations at each card position so that the player can select which cards the player wishes to hold by merely touching the screen location of the desired card.

Additionally, a portion of the screen display 20 may be utilized to display the pay table 80 which would show the winning hand combinations and the amount won by the player for achieving a winning hand combination. Alternatively, as is conventional, the pay table may be printed on the glass areas of the gaming machine 10. Any other conventional and suitable equipment can be included in the gaming machine 10.

A representative deal showing the method of play is displayed in FIG. 1. In this example, the player is playing FIVE PLAY™ Poker and has wagered five credits on each of the five hands. After the player has made his wager and pressed the DEAL/DRAW location 47 to effect the deal, the first hand 111 is displayed to the player. The first hand 111 comprises the Six of Spades 111, the Nine of Spades 112, the Two of Spades 113, the Ten of Spades 114 and the Ace of Hearts 115. The player then selects which cards he wishes to hold.

Figure 2:
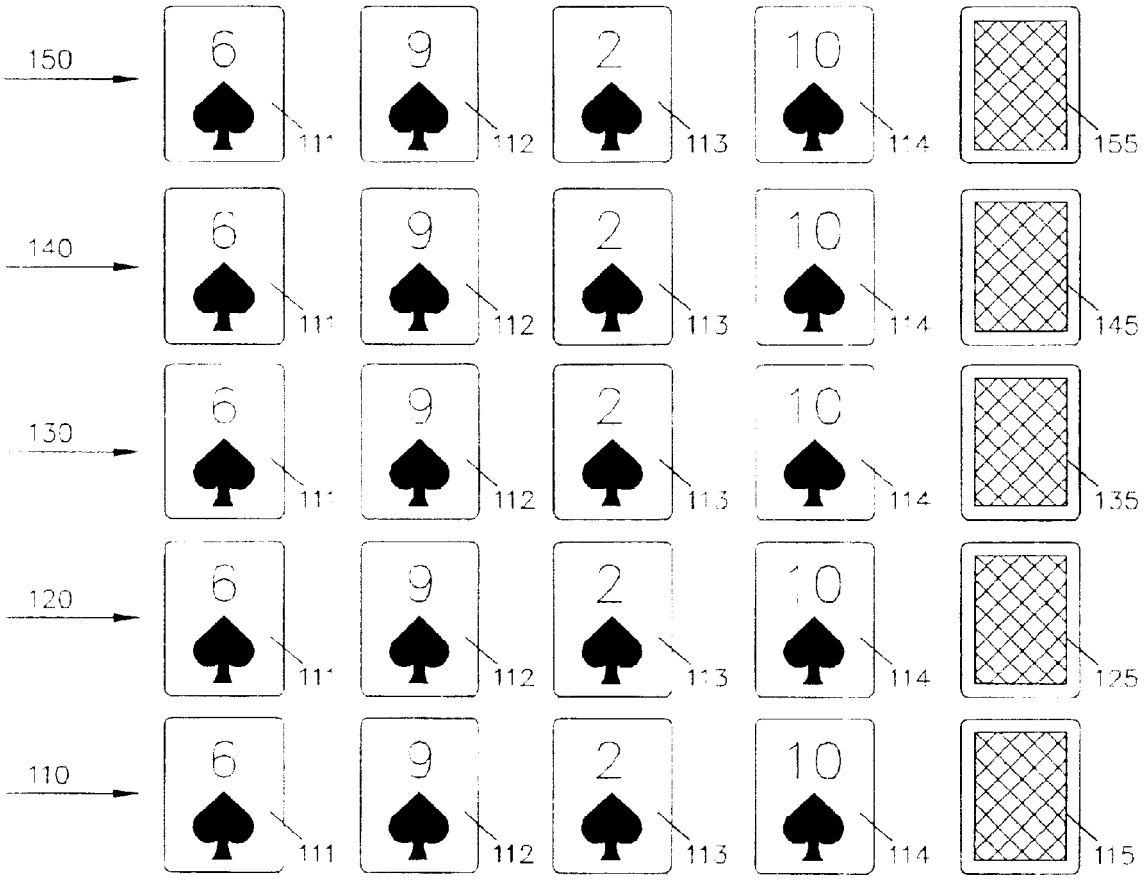
FIG. 2 shows a displays of a representative hold of cards by a player for the method of the present invention.
Figure 3:
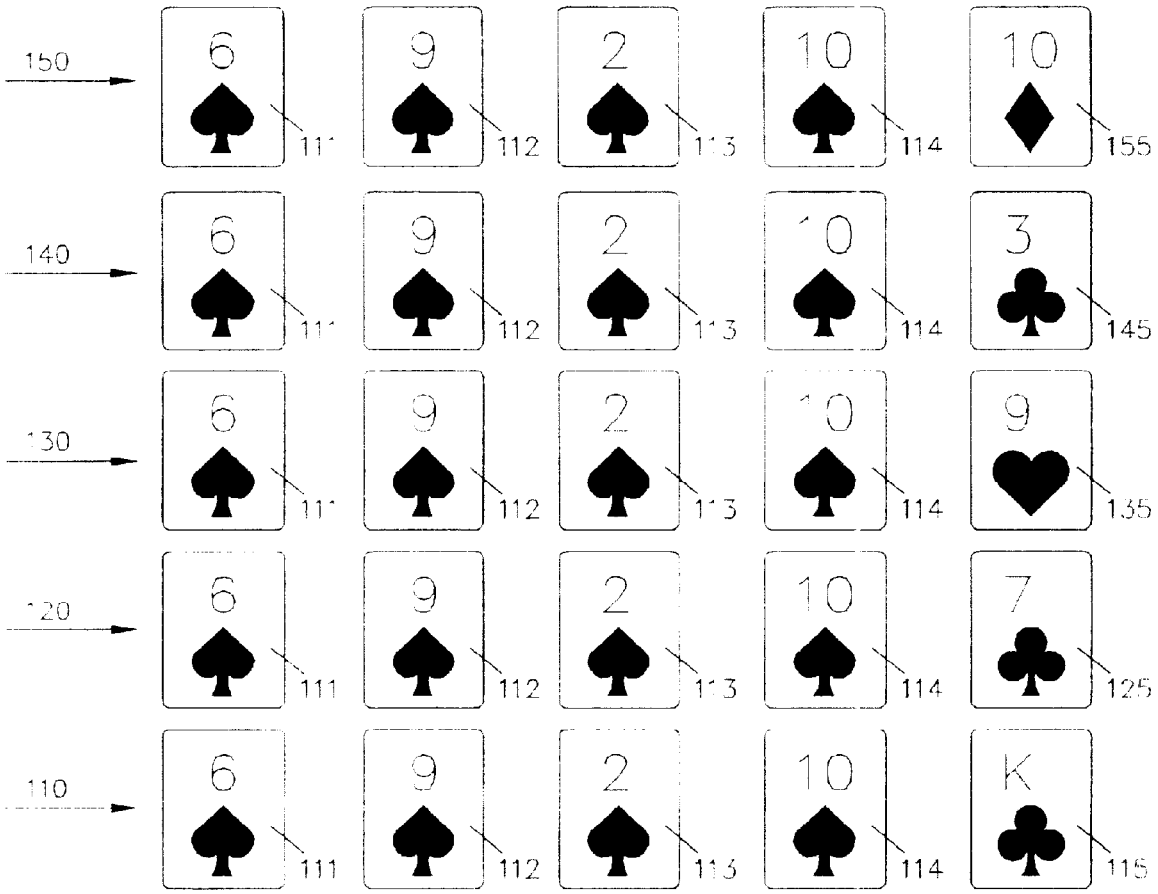
FIG. 3 shows a display of five final hands of a representative play of the method of the present invention.

FIG. 2 shows the video screen display 20 with the cards selected to be held by the player. In the initial hand 110, the player has held the Six of Spades 111, the Nine of Spades 112, the Two of Spades 113 and the Ten of Spades 114. Each of the held cards has been duplicated or reused into the other four hands 120, 130, 140 and 150. Each hand also displays a fifth card face down representing the card position for the extra card needed to complete a final five card hand—fifth card 115 in hand 110, fifth card 125 in hand 120, fifth card 135 in hand 130, fifth card 145 in hand 140 and fifth card 155 in hand 150.

In accordance with the method of play of the present invention, the player has selected to hold a Four Card Flush. This is one of the preselected hand arrangements that would make the player eligible for a bad beat award if the player fails to improve any of the hands after the draw step.

When the player has completed selecting the cards from the first hand the player wishes to hold, the player presses the DEAL/DRAW location 47 to effect the draw step of the method of play and display the fifth card for each hand. The computer controls determine the poker hand ranking of each hand to determine winning and losing plays for each hand.

While the invention has been illustrated with respect to several specific embodiments thereof, these embodiments should be considered as illustrative rather than limiting. Various modifications and additions may be made and will be apparent to those skilled in the art.

What is claimed is:

1. A method for conducting a multiple hand video poker game incorporating a bad beat feature, the multiple hand video poker game including the steps of a player making a wager to play a plurality of video poker hands, dealing a first hand of cards to said player, said player selecting which cards, if any, of the first hand to hold, reproducing said held cards into additional poker hands, discarding cards of said first hand not held, dealing replacement cards into each hand to form completed poker hands, and rewarding the player for each hand combination matching a set of predetermined winning hand combinations based on the amount wagered by the player, the method comprising:

selecting one or more final hands from said winning hand combinations;

selecting one or more qualifying starting hands, each of said qualifying starting hands corresponding to at least one selected final hand; and if the player's first hand prior to replacement matches one of said qualifying starting hands and none of the player's completed poker hands matches the final hand corresponding to the qualifying starting hand obtained, issuing a bad beat award to the player.

2. The method of claim 1 wherein each qualifying starting hand comprises a hand containing one or more but fewer than all the cards necessary to form a corresponding final hand.

3. The method of claim 2 wherein one of said qualifying starting hands is four-to-a-flush and a corresponding final hand is a flush.

4. The method of claim 2 wherein one of said qualifying starting hands is four-to-a-straight and and a corresponding final hand is a straight.

5. The method of claim 1 wherein said bad beat award is a fixed award.

6. The method of claim 1 wherein said bad beat award is a progressive award.

7. A method for conducting a multiple hand video poker game incorporating a bad beat feature, comprising:

a player making a wager to play a plurality of video poker hands;

dealing a first hand of cards to said player;

said player selecting which cards, if any, of the first hand to hold and reproducing said held cards into additional poker hands;

discarding cards of said first hand not held;

dealing replacement cards into each hand to form completed poker hands and rewarding the player for each hand combination matching a set of predetermined winning hand combinations based on the amount wagered by the player;

selecting one or more final hands from said winning hand combinations;

selecting one or more qualifying starting hands, each of said qualifying starting hands corresponding to at least one selected final hand; and if the player's first hand prior to replacement matches one of said qualifying starting hands and none of the player's completed poker hands matches the final hand corresponding to the qualifying starting hand obtained, issuing a bad beat award to the player.

8. The method of claim 7 wherein each qualifying starting hand comprises a hand containing one or more but fewer than all the cards necessary to form a corresponding final hand.

9. The method of claim 8 wherein one of said qualifying starting hands is four-to-a-flush and a corresponding final hand is a flush.

10. The method of claim 8 wherein one of said qualifying starting hands is four-to-a-straight and and a corresponding final hand is a straight.

11. The method of claim 7 wherein said bad beat award is a fixed award.

12. The method of claim 7 wherein said bad beat award is a progressive award.

13. A method for conducting a multiple hand video poker game incorporating a bad beat feature, the multiple hand video poker game including the steps of a player making a wager to play a plurality of video poker hands, dealing a first hand of cards to said player, said player selecting which cards, if any, of the first hand to hold, reproducing said held cards into additional poker hands, discarding cards of said first hand not held, dealing replacement cards into each hand to form completed poker hands, and rewarding the player for each hand combination matching a set of predetermined winning hand combinations based on the amount wagered by the player, the method comprising:

selecting one or more final hands from said winning hand combinations;

selecting one or more qualifying starting hands, each of said qualifying starting hands corresponding to at least one selected final hand, each qualifying starting hand comprising a hand containing one or more but fewer than all the cards necessary to form a corresponding final hand; and if the player's first hand prior to replacement matches one of said qualifying starting hands and none of the player's completed poker hands matches the final hand corresponding to the qualifying starting hand obtained, issuing a bad beat award to the player.

14. The method of claim 13 wherein one of said qualifying starting hands is four-to-a-flush and a corresponding final hand is a flush.

15. The method of claim 13 wherein one of said qualifying starting hands is four-to-a-straight and and a corresponding final hand is a straight.

16. The method of claim 13 wherein said bad beat award is a fixed award.

17. The method of claim 13 wherein said bad beat award is a progressive award.

* * * * *